United States Patent [19]

van Dijk

[11] 4,258,766

[45] Mar. 31, 1981

[54] PRESS FOR PANELS OR SIMILAR BODIES WITH LARGE EXTENSION IN COMPARISON TO THE THICKNESS THEREOF

[75] Inventor: Hendrikus J. M. van Dijk, Gemert, Netherlands

[73] Assignee: Gebroeders van Dijk B.V., Gemert, Netherlands

[21] Appl. No.: 30,540

[22] Filed: Apr. 16, 1979

[30] Foreign Application Priority Data

Apr. 14, 1978 [NL] Netherlands ..... 7804000

[51] Int. Cl.[3] ..... B27D 3/00

[52] U.S. Cl. ..... 100/295; 53/529; 100/215; 193/35 SS; 156/580

[58] Field of Search ..... 144/281 R, 281 A, 246 R; 193/35 SS; 198/776; 156/580; 100/215, 295; 53/529

[56] References Cited

U.S. PATENT DOCUMENTS

| | | | |
|---|---|---|---|
| 2,264,125 | 11/1941 | Wolf et al. | 144/281 R |
| 2,278,552 | 4/1942 | Maurer . | |
| 2,363,779 | 11/1944 | Duffy et al. . | |
| 2,373,770 | 4/1945 | Martin . | |
| 3,135,998 | 6/1964 | Fowler, Jr. et al. . | |
| 4,075,817 | 2/1978 | Gieske, Jr. | 53/529 |

FOREIGN PATENT DOCUMENTS

| | | | |
|---|---|---|---|
| 2648916 | 5/1977 | Fed. Rep. of Germany | 193/35 SS |
| 970545 | 1/1951 | France . | |
| 1545395 | 11/1968 | France . | |
| 2172606 | 9/1973 | France . | |
| 2361220 | 3/1978 | France . | |

*Primary Examiner*—W. Donald Bray

[57] ABSTRACT

A press for panels or like articles comprising a lower press platen having depressed portions, U-shaped channel beams carried in the depressed portions having parts extending downwardly below the press platen, the beams being vertically movable with respect to the press platen and supporting rollers therein. When the press platen is moved to its lower non-pressing position the downwardly extending parts contact the stationary press structure and move the beams upwardly with respect to the platen so that the upper ends of the rollers protrude above the upper pressing surface of the platen to allow easy movement of the panels over the rollers into and out of the press, and when the press platen is lifted to exert its pressing action it moves upwardly with respect to the beams until the upper ends of the rollers no longer protrude above the upper pressing surface of the platen.

2 Claims, 3 Drawing Figures

PRESS FOR PANELS OR SIMILAR BODIES WITH LARGE EXTENSION IN COMPARISON TO THE THICKNESS THEREOF

BACKGROUND OF THE INVENTION

This invention relates to a press for panels or other bodies with large extension in comparison to the thickness, said press having a press platen movable up and down constituting the lower pressing surface, in which platen rolling bodies are provided for moving bodies such as panels to be pressed easily into and out of the press.

Such presses are for instances used for pressing laminate panels for the building industry comprising a light core for instance from a foam plastic or light fibrous material and thinner covering layers of stronger material such as hardboard or thin metal, constituting together so called sandwich panels, in which if desired a suitable adhesive is provided between said layers and the laminate is pressed in such a press, whether or not at elevated temperature, to form a strong laminate with intimately connected layers.

In known presses of this type a number of such panels or other bodies may be pressed simultaneously while being positioned one on top of the other.

SUMMARY OF THE INVENTION

The present invention aims at improving such presses as to a simple structure mainly as to the parts allowing a rapid and easy introduction into the press of the bodies to be pressed and removal of such bodies from the press.

In view thereof, a press according to the preamble is according to the invention mainly characterized in that such rolling bodies have supporting means provided with downwardly extending parts protruding below the bordering areas of the lower surface of the movable press platen, which protruding parts in the lower non-pressing position of said press platen are supported by stationary parts of the press structure in which they keep the rolling bodies with their upper ends in positions above the upper press surface of the press platen to allow easy movement of the bodies to be pressed over such rolling bodies into and out of the press, said supporting means for the rolling bodies being taken up in depressed parts of the press platen so that when the press platen is lifted for exerting its pressing action the rolling bodies will move downwardly therein and will rest with the supporting means in said depressed parts in positions in which the upper ends of the rolling bodies do no more protrude above the upper pressing surface of the press platen.

This gives a very simple structure without the necessity to use springs, linkages and lever mechanisms, driving means etc. for moving the rolling bodies up and down and nevertheless the result is that in the pressing position the entire pressing surface of the platen is active on the bodies to be pressed and these are kept adequately in position without possibility of horizontal movement with respect to the platen. When lowering the press platen to its lower non-pressing position the protruding parts of the supporting means for the rolling bodies will automatically raise the rolling bodies by coming into contact with the said stationary parts of the press structure so that in the very last part of the downward movement of the press platen the rolling bodies and their supporting means with protruding parts no longer follow this downward movement of the platen and are thus lifted to positions with their upper ends above the pressing surface of the press platen. The pressed bodies can thus be moved easily from the press while resting on the rolling bodies and new bodies to be pressed can easily be moved into the press while sliding on such protruding rolling bodies. During pressing there are no pressure concentrations exerted by the rolling bodies onto the lower layer to be pressed as the rolling bodies are out of the way downwardly during pressing.

A preferred embodiment of this structure according to the invention includes rollers as rolling members, said rollers being supported freely rotatably by the supporting means engaging their axes or trunnions, said supporting means being embodied as open channel beams in open channels of the press platen, the protruding parts extending downwardly from the channel beams through holes in the bottoms of the channels in the press platen to lift the channel beams each with a number of rolling members supported therein relatively to the press platen in the lower position of the press platen, said channel beams resting on bottom parts of said channels in pressing positions of the press platen.

BRIEF DESCRIPTION OF THE DRAWING

The invention will now be explained in more detail with reference to the enclosed drawing showing by way of example a preferred embodiment of a press according to this invention. In said drawing.

DESCRIPTION OF THE PREFERRED EMBODIMENT

Figure 1:
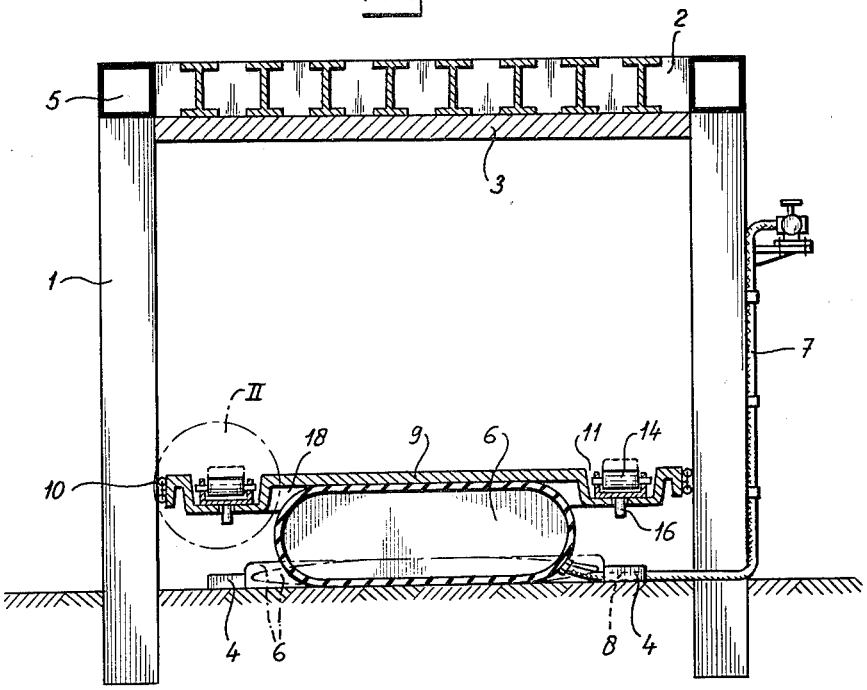
FIG. 1 is a vertical transverse-section through a press according to the invention.

The press as shown comprises a number of portal including a pair of columns or uprights 1 connected across the top by a girder or horizontal member 2 structures 1,2 with an upper press platen 3 rigid and stationary therein or movable up and down by spindles or the like not shown, if this is desired for instance in case of the height of the pile of bodies to be pressed differing considerably. The bottom of the press may simply be the floor of the factory and this has supporting strips or rails 4 for instance of metal between the legs 1 of the portals and extending the whole length of the press. The portals 1,2 may be connected in a longitudinal direction of the press by longitudinal beams 5 and there may be other connections to make this structure into a sufficiently rigid and strong unit. Between the strips 4 there are inflatable air bags 6 of rubber or similar material which may be square, rectangular or circular. In a press of a width of 1.5 m and a length of 12 m there may for instance be five or more of such bags in a row. Each of them is connected by a hose 7 to a source for air under pressure, there being preferably a header duct for supplying all the air bags with air and extending along the portal structure, having suitable valves for opening and closing the air supply to the bags and for allowing deflating by discharge of the air in a manner known very well to the expert. There may be reducing means in the valves as usual to keep the pressure of the air fed to the bags at a desired level. The hoses 7 extend through suitable bores or slots at 8 in the adjacent strip or rail 4.

A lower press platen 9 rests on the air bags 6. If desired said platen 9 is guided by rollers 10 along the columns 1 of the portal structure. Said platen 9 has two depressed parts 11 not far from the side edges, with bores 12 in the bottom thereof. In said parts 11 there are U-shaped beams 13 with the openings pointing upwardly. Therein rollers 14 with trunnions 15 are supported so as to be freely rotatable. The U-beams at regular distances have downwardly protruding pins 16 extending through the bores 12.

Figure 2:
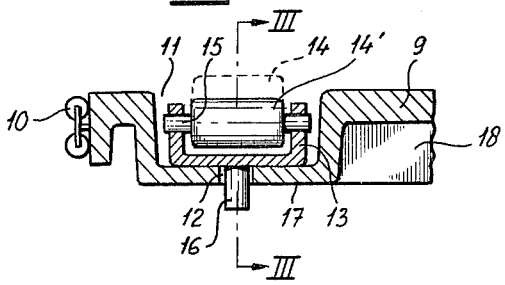
FIG. 2 is a transverse-section on a large scale through a part of the section of FIG. 1 indicated by circle II.
Figure 3:
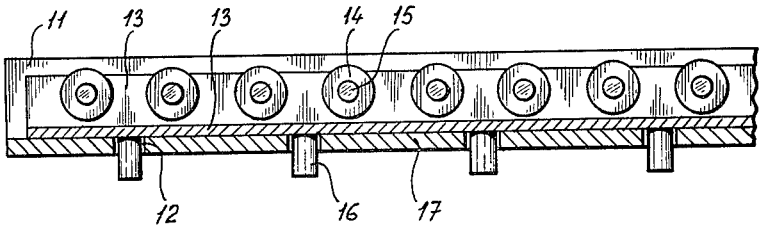
FIG. 3 is a partial section along the line III—III in FIG. 2.

If there is no air pressure in the bags 6, the platen 9 rests with the bottoms 17 of the depressed parts 11 on the strips or rails 4. Thereby said strips keep the pins 16 with their lower end at the same height as the bottom 17. Thereby the U-beams 13 take up a raised position with respect to the press platen 9, so that the rollers 14 protrude above the top surface of the platen 9 as shown by dashed line and by numeral 14 in FIG. 2. It is thus now possible to easily move the bodies to be pressed such as a pile of layers to form a number of sandwich panels, over said rollers into and from the press along a path between the columns 1 of the portals and thus in the direction perpendicular to the plane of the drawing of FIGS. 1 and 2 and in the plane of FIG. 3. During pressing, the press platen 9 is raised by the inflated bags 6 so that the pins 16 are free from the strips 4, whereby the beams 13 and the rollers 14 take up the position indicated by full lines in FIG. 2 with the rollers in position 14', so that the rollers do not protrude above the pressing surface of platen 9 and thus do not contact the bodies to be pressed.

The press platen 9 may be reinforced by transverse rigids 18 between the depressed parts 11, said rigids defining between them pockets for the air bags 6. The air bags 6 may be connected to the floor or to the platen 9 but this is not always necessary and they may thus be easily replaced, checked and repaired.

The press according to the invention allows easy pressing of very long bodies. If such bodies are also very wide a wider press may be used and there may be two or more air bags 6 one to the side of the other and it may be preferable in such a case to have more than two depressed parts 11 with U-beams 13 and rollers 14 in the press platen 9. Instead of rollers, balls may be used, rotatable in sockets in parts such as the beams 13, but this will usually give much more sliding friction. Each ball may have its own socket and this may be lined with or made from a material with low friction coefficient such as a polyamide or polyethylene.

I claim:

1. A press comprising a lower press platen having an upper pressing surface and being movable up and down, and rolling bodies provided on said press platen for easily moving articles to be pressed into and out of the press, characterized by supporting means carried in depressed portions of said press platen and being vertically movable with respect thereto, said rolling bodies being rollably supported by said supporting means, said supporting means being provided with parts extending downwardly below said press platen, and stationary press structure positioned below said press platen, whereby when the press platen is moved to its lower non-pressing position the downwardly extending parts of the supporting means contact said stationary press structure and are supported thereon, thereby moving said supporting means upwardly with respect to said press platen so that the upper ends of said rolling bodies are in positions above said upper pressing surface of said press platen to allow easy movement of the articles to be pressed over said rolling bodies into and out of the press, and when the press platen is lifted from its lower non-pressing position to exert its pressing action, said supporting means will at first remain stationary with said downwardly extending parts thereof supported on said stationary press structure so that said press platen moves upwardly with respect to said supporting means until said supporting means are again carried in said depressed portions of said press platen in positions in which the upper ends of said rolling bodies no longer protrude above said upper pressing surface of said press platen.

2. A press according to claim 1, characterized in that said rolling bodies comprise rollers and said supporting means comprise channel beams open at their top, said rollers having trunnions supported by the upstanding walls of the channel beams.

* * * * *